US006192545B1

(12) United States Patent
Gessert

(10) Patent No.: US 6,192,545 B1
(45) Date of Patent: Feb. 27, 2001

(54) SCOURING APPARATUS INCORPORATING HOLDER FOR DETACHABLY RETAINING SCOURING PAD AND SELECTIVELY ATTACHABLE HANDLE

(76) Inventor: Roy E. Gessert, 10150 Stern Ave., Cupertino, CA (US) 95014

( * ) Notice: Subject to any disclaimer, the term of this patent is extended or adjusted under 35 U.S.C. 154(b) by 0 days.

(21) Appl. No.: 09/265,194

(22) Filed: Mar. 10, 1999

(51) Int. Cl.[7] ..... A47L 13/10; A47L 13/44
(52) U.S. Cl. ..... 15/229.13; 15/229.12
(58) Field of Search ..... 15/209.1, 229.11, 15/229.12, 229.13

(56) References Cited

U.S. PATENT DOCUMENTS

| | | | | |
|---|---|---|---|---|
| 1,788,187 | * | 1/1931 | Cahill | 15/229.13 |
| 2,124,429 | * | 7/1938 | O'Brien | 15/229.13 |
| 2,364,319 | * | 12/1944 | Schimel | 15/229.13 |
| 3,090,064 | * | 5/1963 | Garrett | 15/229.13 |
| 3,090,065 | * | 5/1963 | Krieps et al. | 15/229.13 |
| 3,100,311 | * | 8/1963 | Tutino | 15/229.13 |
| 3,105,989 | * | 10/1963 | Bell et al. | 15/229.13 |

FOREIGN PATENT DOCUMENTS

| | | | | |
|---|---|---|---|---|
| 823646 | * | 12/1951 | (DE) | 15/229.13 |
| 38069 | * | 3/1931 | (FR) | 15/229.13 |
| 38108 | * | 4/1931 | (FR) | 15/229.13 |

* cited by examiner

*Primary Examiner*—Terrence R. Till
(74) *Attorney, Agent, or Firm*—John J. Leavitt

(57) ABSTRACT

Presented is a scouring apparatus for holding a scouring pad in position for use. The apparatus includes a scouring pad holder formed as a shell symmetrical about a central axis and having a tubular "grasp" portion for engagement by either the fingers or a handle assembly, and further having a skirt portion defining a shallow recess within which is mounted a tine having at least one spiral turn the free end of which lies outside the recess so that the tine may be rotated into an associated scouring pad to draw the scouring pad into the shallow recess and detachably retain the scouring pad therein during use, but enabling removal and laundering or replacement of the scouring pad.

16 Claims, 4 Drawing Sheets

Fig_1
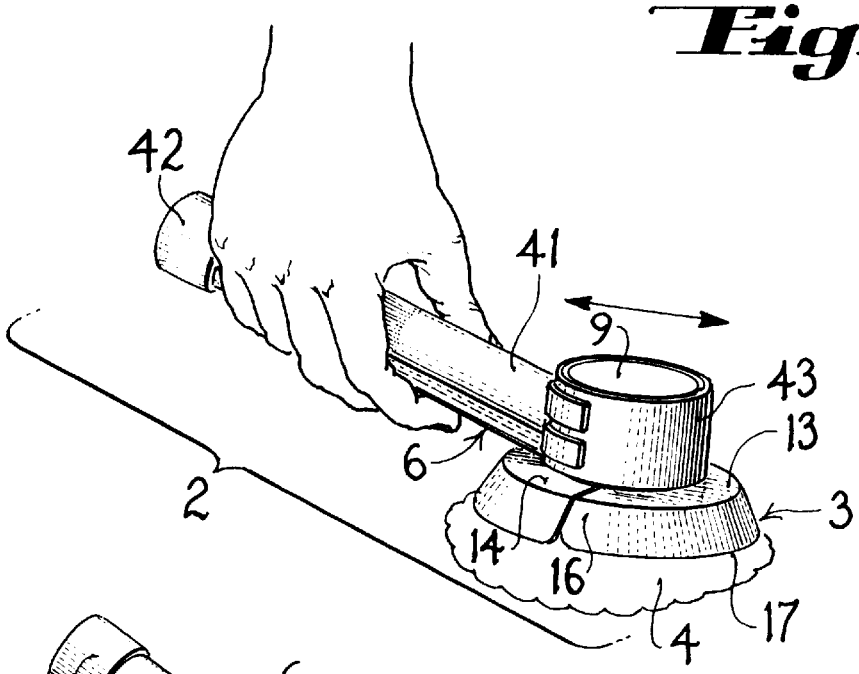
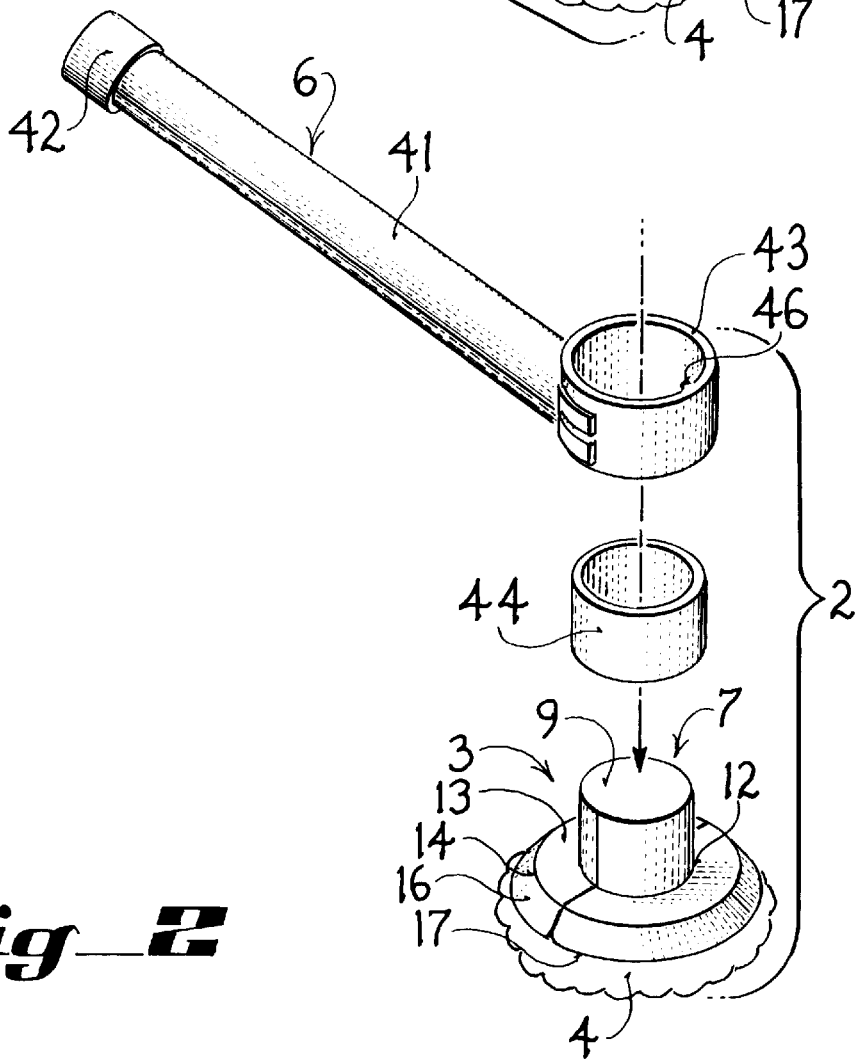
Fig_2

Fig_6
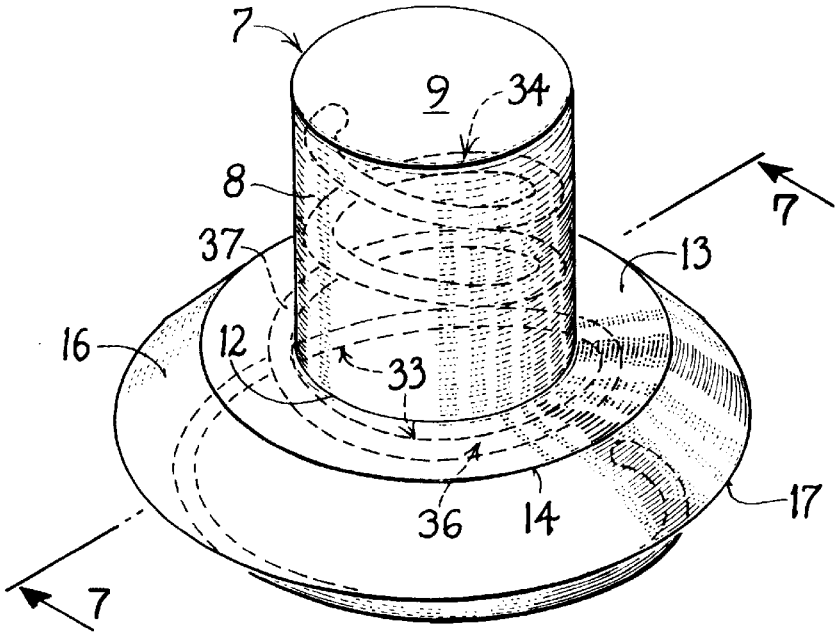
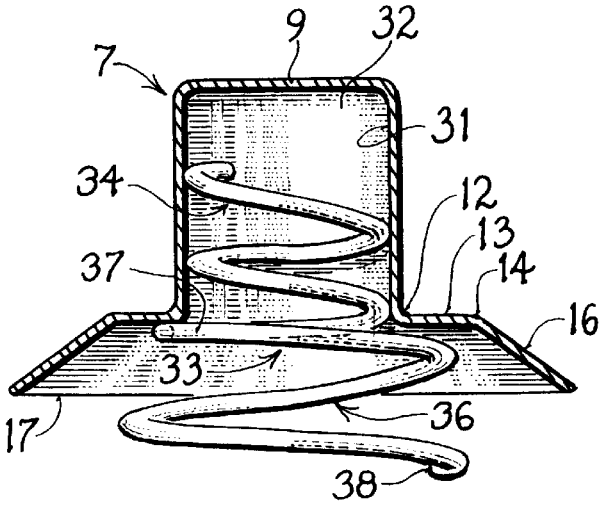
Fig_7

SCOURING APPARATUS INCORPORATING HOLDER FOR DETACHABLY RETAINING SCOURING PAD AND SELECTIVELY ATTACHABLE HANDLE

BACKGROUND OF THE INVENTION

1. Field of the Invention

This invention relates to scouring apparatus for cleaning cooking utensils and equipment, and particularly to a scouring apparatus incorporating a holder for detachably securing a scouring pad in position of use, and adapted to selectively detachably receive an elongated handle for manipulation of the holder in a scouring motion from a point spaced from the scouring pad and holder.

2. Description of the Prior Art

A preliminary patentability and novelty search has revealed the existence of the following United States patents.

| | | |
|---|---|---|
| 1,395,652 | 1,620,903 | 1,653,652 |
| 1,660,351 | 1,686,526 | 1,689,769 |
| 1,820,183 | 1,899,552 | 1,905,307 |
| 2,124,429 | 2,496,371 | 2,514,481 |
| 2,620,501 | 2,629,890 | 2,778,049 |
| 2,799,038 | 3,015,118 | 3,090,064 |
| 3,473,184 | 4,071,983 | 4,232,420 |
| 4,244,075 | | 5,426,810 |

It will be seen from the prior art listed above that for an interval spanning more than seventy years a great deal of creativity was exercised to develop the many different types of devices of accomplishing a rather mundane, yet unpleasant, function, namely, the cleaning of cooking equipment and utensils. Close scrutiny of the structures and mode of operation of the devices described and illustrated in the patents listed above also indicate that there prior art devices are structurally and functionally different from the structure and mode of operation of the invention disclosed herein.

There are several different types of scouring pads, each being an article of manufacture that is generally available in a variety of stores where household goods and utensils are sold. One familiar type is sold under the trademark TUFFY and is formed from synthetic resinous strand material formed generally into a spherical body or mass that is customarily held in the hand and compressed when pressure is applied and the mass is manipulated to effect a scouring action. Another type of scouring pad is formed from stainless steel wire or strands, also gathered together during the manufacturing process to form a generally flat circular body or mass that may be manipulated by hand or with a holder to effect a scouring action.

It is not generally known that these two types of scouring pads may be used and re-used following a cleaning operation after use, such as might be effected in a conventional dishwasher. Accordingly, it is one of the important objects of the present invention to provide a holder for such scouring pads that will enable application of scouring pressure on the holder and therefore the detachably secured pad and manipulation thereof to effect a scouring action, while detachably retaining the scouring pad to facilitate removal of the scouring pad from the holder for cleaning, and/or cleaning both in assembled form.

The manipulation of a hand-held scouring pad can be detrimental to the fingers and hands, particularly where it is used to clean metal cooking utensils and barbecue grills.

Accordingly, it is another important object of the invention to provide a holder for a scouring pad such that the holder includes a generally cylindrical projection integral at one end with a radially projecting skirt the periphery of which is adapted to impinge on the scouring pad so as to enable maximum localized scouring pressure to be applied to the scouring pad during use, while the cylindrical projection may be grasped by a hand to facilitate manipulation of the holder and thus the scouring pad without the hand coming into contact with the scouring pad or the utensil or equipment being scoured.

The detachable securement of a scouring pad to a holder has been the subject of much research and development effort as indicated by the patents noted above. Accordingly, it is another important object of the invention to provide a holder for a scouring pad such that the holder may be grasped by a hand or by a detachable handle, and the holder is equipped with a helically wound spiral tine adapted to be turned into the scouring pad to detachably impale and secure the scouring pad to the holder.

For some types of cleaning, such as cleaning a hot barbecue grill, or a hot pancake griddle, it is advantageous to be able to manipulate the holder for a scouring pad from a reasonable distance, thus protecting the hands and forearms from coming into contact with the heated grill or griddle. Accordingly, another object of the invention is the provision of a detachable handle that may be selectively attached or detached from the holder and which, when attached, facilitates manipulation of the holder and scouring pad from a safe distance from the holder and scouring pad.

Another object of the invention is the provision of a scouring pad holder equipped with a helically wound wire mounting portion detachable secured to the holder and including a remaining integral wire portion constituting a tine that spirals radially outwardly from the mounting portion and helically from the holder for detachable penetration by the tine of the body of an associated scouring pad for securement thereof to the holder.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the scouring apparatus of the invention includes a generally cylindrical body symmetrical about a central axis and including a cylindrical projection adapted to be grasped by the fingers of one hand or by a selectively attachable elongated handle. Integral with one end of the cylindrical projection is a radially outwardly projecting skirt including concentric flat and conical portions. A helically wound spiral tine is mounted by one end on the holder within the skirt area and projects axially outwardly beyond the peripheral edge of the skirt to present a free end adapted to penetrate and be turned spirally into an associated scouring pad to hold the pad detachably secured to the holder with the periphery of the skirt impinging on the scouring pad. An elongated digitally manipulable handle is providing having on one end a cylindrical tubular member adapted to detachably circumscribe and grasp the cylindrical projection to enable manipulation of the scouring pad from a safe distance from the utensil or equipment being scoured.

BRIEF DESCRIPTION OF THE DRAWINGS

FIG. 1 is a perspective view illustrating the scouring pad holder of the invention assembled with a detachable handle and a scouring pad and showing how the handle-equipped scouring apparatus may be grasped and manipulated by the handle.

FIG. 2 is a perspective view showing major components of the scouring apparatus of FIG. 1 in exploded form to illustrate the manner of assembly of the scouring apparatus of FIG. 1.

FIG. 6 is a view similar to FIG. 4 but illustrating another embodiment of the scouring pad holder in which the interior surface of the tubular cylindrical projecting portion is utilized to retain the spirally wound and helically extending tine mounted on the scouring pad holder.

FIG. 7 is a cross-sectional view taken in the plane indicated by the line 7—7 in FIG. 6.

DESCRIPTION OF THE PREFERRED EMBODIMENTS

There are many different types of scouring pads that may be purchased commercially for cleaning many different products, including grills, griddles, oven broilers, sports equipment, tools, whitewall tires and of course greasy pots and pans, and other equipment used for cooking, particularly barbecue grills. Cleaning pads sold by Minnesota Mining and Manufacturing Company under the trademark SCOTCH BRIGHT comprise a flat mass of non-metallic fibers, or a single cured strand of stainless steel meshed to form a scouring pad. Another type of scouring pad is sold by The Clorox Company under the trademarks TUFFY and S.O.S. and comprise a generally cylindrical roll formed from an elongated strip of woven synthetic resinous strands. Other types of scouring pads are sold by the Chore Boy division of Reckitt and Coleman, Inc. under various trademarks, including GOLDEN FLEECE and CHORE BOY, which are used in conjunction with copper, bronze and stainless steel scouring pads, as well as "plastic puffs" and sponges.

While all of these scouring pads are more or less effective for the purpose for which they are designed, they all share a common characteristic, i.e., each must be manipulated by directly grasping the pads with the fingers of one or both hands, and with the fingers or hands, apply pressure directly on the pad to effectively utilize their scouring capabilities. The subject matter of the invention described and illustrated herein provides a means for holding and manipulating such scouring pads without having to utilize direct pressure of the fingers or hand on the pad, thus eliminating or at least minimizing the possibility of trauma that sometimes occurs to the fingers and hands when the scouring pads are manipulate directly by the fingers and/or hands, and which trauma is typically obviated by donning a glove, which holder (and glove) also function to protect the hand from contamination generated during a scouring operation.

Figure 3:
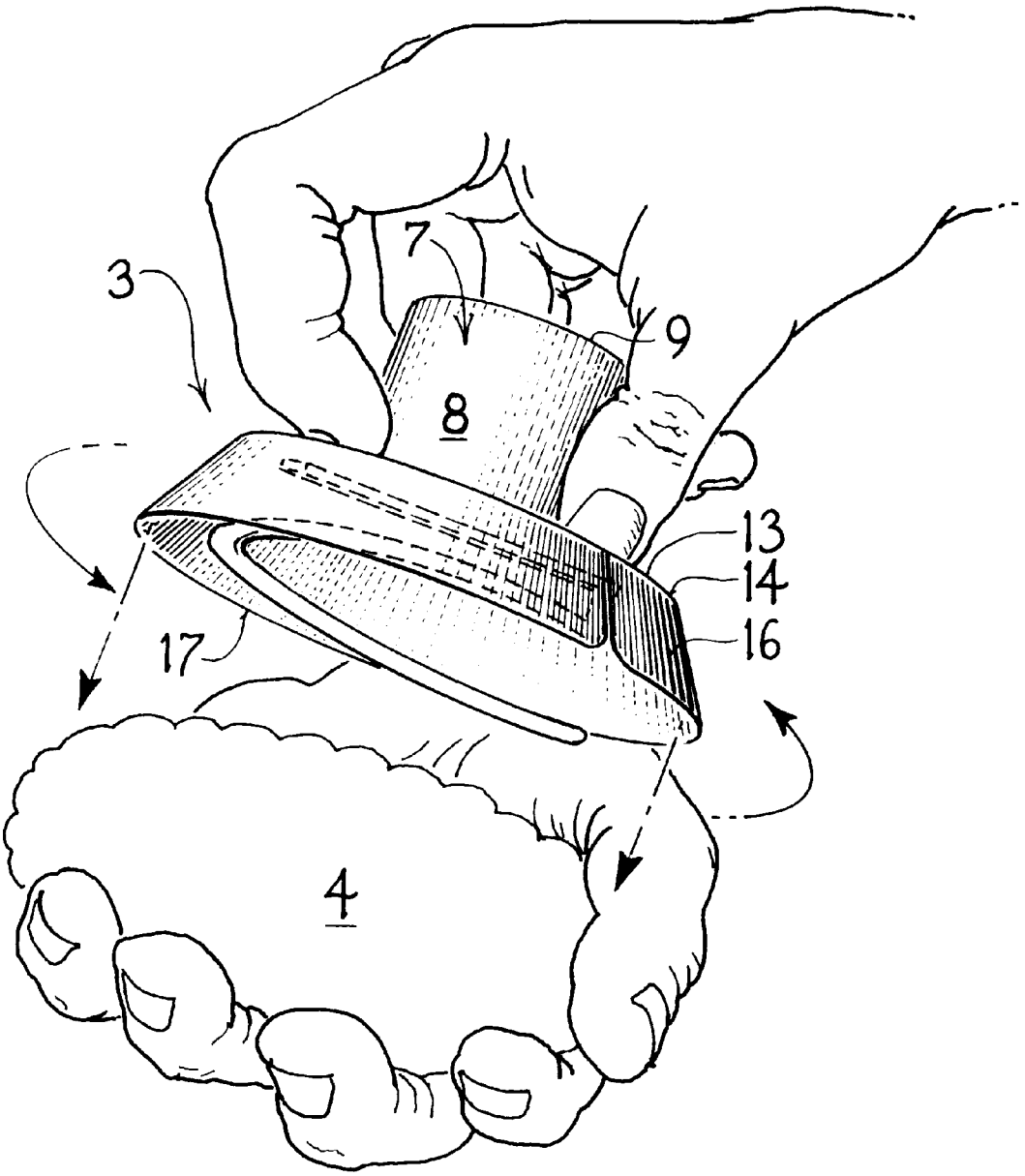
FIG. 3 is a perspective view of the scouring apparatus of the invention shown apart from the handle and grasped by the fingers of one hand while the scouring pad is supported by the other hand and illustrating the manner of detachable attachment of the scouring pad to the holder by relative rotation of the holder and the scouring pad to effect impaled penetration of the helically wound tine into the body of the scouring pad.
Figure 4:
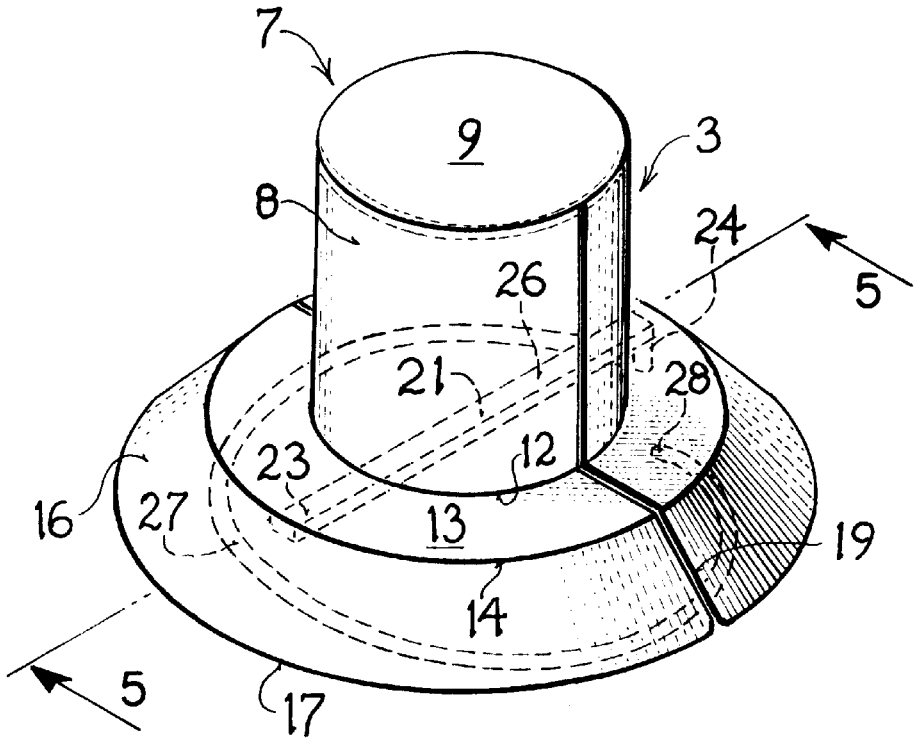
FIG. 4 is a perspective plan view illustrating the scouring pad holder apart from the scouring pad and apart from the handle and showing in broken lines the manner of attachment and the helical extension of the spirally wound tine toward the periphery of the skirt portion of the holder.
Figure 5:
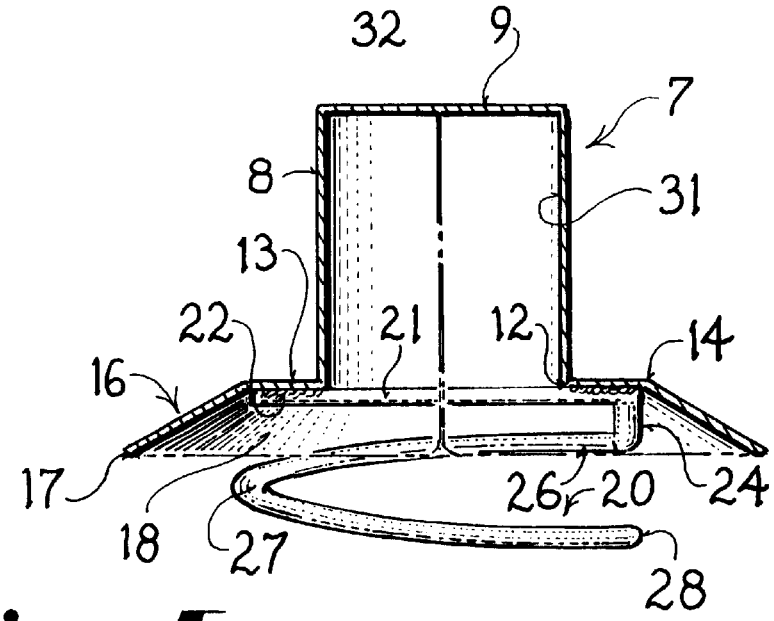
FIG. 5 is vertical cross-sectional view taken in the plane indicated by the line 5—5 in FIG. 4.

Accordingly, in terms of greater detail, and referring to the drawings herein, the scouring apparatus of the invention is designated generally by the numeral 2, and includes a unitary scouring pad holder body designated generally by the numeral 3 that is preferably formed from stainless steel. In one aspect of the invention, the holder body 3 may be fabricated from a "blank" of stainless steel sheet configured to provide, when pressed, a structure as illustrated in FIGS. 3–5, or it may be deep-drawn from an appropriate metal to provide the same configuration, and in a second and preferred aspect, the scouring pad holder body may be spin-formed from a flat stainless steel sheet or injection molded from suitable synthetic resinous material into the structure illustrated in FIGS. 6 and 7. The scouring pad holder of both aspects is equipped with means hereinafter to be described for detachably securing to the holder a scouring pad designated generally by the numeral 4. The scouring pad comprises a cohesive body having a multiplicity of intersticies formed by integration of strands of ferrous metal, non-ferrous metal or synthetic resinous material. The scouring apparatus also includes an elongated handle designated generally by the numeral 6 and designed for detachable engagement to the holder 3 to enable manipulation of the holder and attached scouring pad by manipulation of the handle. Referring to the scouring pad holder per se, particularly as illustrated in FIGS. 3, 4 and 5, it will be seen that the scouring pad holder per se as there shown comprises an article of manufacture that may be utilized effectively for performance of a scouring function even without the use of the elongated handle 6. As there shown, the scouring pad holder 3 comprises a tubular cylindrical grasp-portion designated generally by the numeral 7 formed by a cylindrical wall 8 having a diameter of approximately 1.25 inches and a length of approximately 1.37 inches. These dimensions have been found to be convenient, but other dimensions could be used as well. One end of the tubular grasp-portion 7 is closed by a wall 9, while the opposite end of the grasp-portion is open, the cylindrical open end edge 12 merging smoothly and integrally with the inner periphery of an annular radially extending flange 13 oriented perpendicular to the central axis of the tubular cylindrical grasp-portion of the scouring pad holder.

At its outer periphery, the annular flange 13 merges smoothly and integrally and is coincident with the truncated end 14 of a conical shell designated generally by the numeral 16, which is also provided with a base edge 17 that lies parallel to the truncated end 14 and perpendicular to the central axis. The right truncated conical shell 16, cooperating with the flat annular flange 13, thus forms a shallow inverted dish-shaped recess 18 that communicates with the interior of the tubular cylindrical grasp-portion 7 as shown.

In the embodiment of the scouring pad holder per se illustrated in FIGS. 3, 4 and 5, it will be seen that the cylindrical wall 8 of the grasp-portion, the flat annular flange 13 and the truncated conical shell 16 are all provided with a continuous slot 19 that extends from the top end wall 9 to the lower base end edge 17. This "slot" is formed by the close association of the opposite edges of the sheet stainless steel "blank" when the holder body "blank" is press-formed. The press-formed stainless steel body is retained in the configuration illustrated by the top end wall 9 as a result of the forming operation.

Referring to FIGS. 3, 4 and 5, it will there be seen that to secure the scouring pad 4 detachably yet securely to the underside of the holder within the recess 18, there is mounted within the recess a tine formed from stainless steel wire and designated generally by the numeral 20 and including a base member 21 that extends diametrically across the open end of the grasp-portion 7 within the recess 18 as shown in the drawings. To retain the tine permanently mounted on the holder, the base member 21 is contiguous with the undersurface of the flat annular flange 13 as shown best in FIG. 5. The base member 21 may or may not be flattened, as shown, and the end portions 22 and 23 of the base member are preferably welded to the undersurface of the annular flange 13 as shown, thus retaining the cylindrical grasp-portion in the configuration in which it has been formed.

Again referring to FIG. 5, it will be noted that the end portion 23 of the base member 21 is integral with a perpendicular extension 24 the end of which remote from the base member is in turn integral with the associated end portion 26 of a spirally wound tine portion 27. As shown in FIGS. 4 and 5, the spirally wound tine portion 27 extends for approximately 270 degrees to 370 degrees from the extension 24, the spirals helically away from the extension 24 for approximately ⅜ inch to ½ inch, so that the end 28 of the spirally wound tine may be impaled into the body of the scouring pad by counterclockwise rotation of the holder body in relation to the scouring pad, thus causing the spirally wound tine portion 27 to be completely embedded or "impaled in the material from which the scouring pad body is formed. While the spirally wound tine as illustrated favors relative counterclockwise rotation of the holder in relation to the scouring pad to effect impalement, it will of course be obvious that the tine structure could as easily be mounted to accommodate clockwise relative rotation of the holder in relation to the scouring pad to effect impalement of the tine in the scouring pad.

It should also be noted that as the counterclockwise rotation of the holder body is effected, the associated body portion of the scouring pad body is pressed into the recess 18 by the penetrating action of the spirally wound tine into the body of the scouring pad. The exposed underside and peripheral edge portions of the scouring pad body are exposed for use in abrading or scouring a surface to be cleaned while the remainder of the scouring pad body is held securely yet detachably within the recess 18. It will be seen that after about 270 to 370 degrees of counterclockwise relative rotation of the holder body and the scouring pad body, the short extension 24 comes into intimate contact with the scouring pad material through which the tine has penetrated.

When the extension 24 impinges on the scouring pad material, relative rotation of the holder body and the scouring pad body is thus terminated, and a portion of the scouring pad lies securely yet detachably within the recess 18, held there by the embedded or "impaled" spirally wound tine portions 26 and 27, with other portions of the scouring pad body projecting vertically below and radially outwardly beyond the lower edge 17 of the conical shell 16 for scouring or abrading purposes.

Referring now to the embodiment of the invention illustrated in FIGS. 6 and 7, it will be seen that the scouring pad holder body is essentially of the same configuration as the holder body illustrated in FIGS. 1–5. The function and mode of operation is also identical, and accordingly corresponding elements of the holder body will be referred to by corresponding reference numerals. Additionally, the description above of the structure of the embodiment illustrated in FIGS. 4 and 5, with the exception of the slot 19, is included hereat by reference.

One of the differences present in this embodiment of the invention is that the holder body is formed from a stainless steel preformed "blank" by the process of spin-forming rather than by press-forming as with the embodiment illustrated in FIGS. 1–5, or may be injection molded from appropriate synthetic material. As a consequence, the slot 19 has been eliminated. A second difference is that the tine structure has been modified as will hereinafter be explained.

Referring to FIGS. 6 and 7, it will be noted that the tubular cylindrical grasp-portion 7 is hollow, as before, having an internal peripheral surface 31 which, will the end plate 9, forms a hollow cavity 32 within the grasp-portion 7. It is within this internally cylindrical hollow cavity that the tine assembly, designated generally by the numeral 33, is mounted. In this regard, the tine assembly in this embodiment comprises a predetermined length of stainless steel wire spirally and helically wound over its entire length and generally defining a first helically wound mounting portion 34 that projects into the hollow interior of the grasp-portion, and a helically wound integral second or tine portion designated generally by the numeral 36.

In this second or tine portion 36 in which the turns of the helix are an integral continuation of the helix turns within the cavity 32, the turns progressively increase in diameter as they emerge from the cavity, with the first turn 37 to emerge from the cavity contiguously overlying the undersurface of the flat annular plate 13 for approximately 180 degree to form a "pinch" point or location for purposes which will hereinafter be explained. From this first emerging turn, the helix turns gradually increase in diameter and project axially out of the recess 18 to beyond the peripheral edge 17, terminating in a tine end 38 that lies spaced axially approximately ¼" beyond the peripheral edge 17 and spaced about ¼ inch radially inwardly from the peripheral edge 17.

To insert the first helically wound cylindrical mounting portion 34 within the hollow interior of the grasp-portion, the helically wound mounting portion is simply compressed radially to diminish the diameter to less than the internal diameter of the cavity, and the mounting portion is then inserted to its maximum depth determined by impingement of the first emerging turn 37 on the underside of the flat annular plate 13. The compression of the mounting portion is then released, resulting in the spirally wound helical turns increasing in diameter to impinge resiliently against the inner peripheral surface 31 of the cavity with sufficient force to securely retain the tine assembly mounted in the holder, yet, upon necessity, being removable therefrom by recompression of the helical turns and axial extraction.

With the tine assembly thus mounted and the outer turn of the tine assembly projecting beyond the rim edge 17, all that is required to detachably mount a scouring pad onto the holder is to orient the scouring pad and holder as illustrated in FIG. 3, bringing the tine end 38 into contact with the scouring pad material, then rotating the holder counterclockwise while holding the scouring pad against rotation. The result is that the tine is essentially turned into the body of the scouring pad, drawing the scouring pad into the recess 18 until the scouring pad material reaches the "pinch" point where the first emerging turn of the helix continguously abuts the undersurface of the annular flange 13. At this point, rotation of the holder is terminated and the scouring pad remains securely yet detachably mounted on the holder for manipulation either by hand or with the handle to effect a scouring action.

Referring to FIGS. 1 and 2, it will there be seen that the scouring pad holder per se as depicted in FIGS. 3 through 7, inclusive, is adapted to detachably receive the handle designated generally by the numeral 6 as previously discussed and illustrated in FIGS. 1 and 2. As there depicted, the handle comprises an elongated member 41, conveniently formed from a length of plastic tubing, and at one end is provided with a cap 42. At its other end remote from the cap 42, the handle is provided with a tubular cylindrical member 43 that is either formed integrally by injection molding with the associated end of the handle member 41 or is permanently attached thereto in a manner so that the longitudinal axis of the handle is perpendicular to the axis of the tubular cylindrical member 43. Where expedient, to effect an ergonomically desirable relationship between the scouring pad surface and the hand and forearm, the longitudinal axis of the handle may be offset from the axis of the tubular cylindrical member 43.

The tubular cylindrical member 43 is conveniently larger in diameter than the outside diameter of the cylindrical "grasp"7. To securely yet detachably connect the handle to the "grasp" there is provided a tubular cylindrical bushing 44 preferably formed from approximately pliant plastic material, and dimensioned to slip snugly over the outer periphery of the cylindrical "grasp" 7 as illustrated in FIG. 1. The tubular cylindrical member 43 on the associated end of the handle is provided on its inner periphery with a rib 46 that is parallel to the direction in which the handle is applied to the holder, thus compressing the pliant plastic material of the tubular cylindrical bushing 44 and resiliently, securely, yet detachably mounting the handle 6 on the grasp-portion 7 as shown in FIG. 1 so that the tubular cylindrical member 43 is concentrically disposed resiliently about the pliant plastic bushing 44, which in turn is concentrically mounted about the outer periphery of the grasp-portion 7. Manipulation of the elongated handle portion 41 thus effects manipulation of the holder 3 and the scouring pad 4 detachably mounted thereon.

From the foregoing, it will be apparent that the holder with scouring pad detachably secured thereto may be manipulated without the use of the handle merely by digitally grasping the grasp-portion 7 and manipulating the holder and scouring pad to effect a scouring function. In this regard, it is noted that the base edge 17 may be tipped so that a relatively short arcuate portion of the skirt 16 and an associated portion of the scouring pad may be pressed into corners so as to abrade the surface of such corners to remove contaminate particles stuck thereto. Alternatively, the entire holder with scouring pad attached may be manipulated by hand to scour the interior surfaces of pots and pans to remove food or other contaminate particles therefrom, and can also scour the outer surfaces of pots and pans that have been discolored by exposure to open flames.

For larger cleaning chores, such as scouring and cleaning a barbecue grill or griddle, the handle may be applied as discussed above and the scouring pad manipulated to effect a scouring action on the surfaces to be cleaned. Used in this manner, it will be apparent that the hands do not come into close contact with the holder or the scouring pad, thus minimizing or preventing the hands from becoming abraded or contaminated with the material being removed from the surfaces being scoured.

Having thus described the invention, what is believed to be new and novel and sought to be protected by letters patent of the United States is as follows.

I claim:

1. Scouring apparatus for cleaning articles such as pots, pans, grills, griddles and diverse other equipment through use of a scouring pad, comprising:

a) a scouring pad holder adapted to detachably retain a scouring pad thereon for digital manipulation of said holder and the attached scouring pad to effect a scouring function;

b) said scouring pad holder comprising a unitary hollow shell symmetrical about a central axis and including a tubular grasp-portion having axially spaced first and second ends joined by inner and outer peripheries, and an annular skirt portion having inner and outer peripheries, said inner periphery of said skirt portion being integrally joined to one end of said tubular grasp-portion and defining a shallow recess communicating with the interior of said tubular grasp-portion; and c) tine means mounted on said holder and including a tine mounting portion and at least one spirally wound tine extending integrally from said tine mounting portion and projecting at least 180 degrees about said central axis in a free end out of said recess for detachably impaling a scouring pad thereon to detachably retain said scouring pad mounted on said holder.

2. The scouring apparatus according to claim 1, wherein said scouring pad holder is formed from a material selected from the group consisting of ferrous metal, non-ferrous metal, plastic, or resin impregnated woven fiber material.

3. The scouring apparatus according to claim 1, wherein said recess formed by said skirt portion possesses a depth of about one-fourth inch.

4. The scouring apparatus according to claim 1, wherein said spirally wound tine presents a free end spaced about one-fourth inch outside said recess.

5. The scouring apparatus according to claim 1, wherein said tine mounting portion is anchored at one end to the bottom of said recess adjacent said one end of said tubular grasp-portion and said integral tine spirals helically out of said recess in progressively larger spiral turns to terminate in a free end spaced about one-fourth inch from the skirt portion whereby said free end may impale a scouring pad and relative rotation of said holder and said scouring pad fully detachably impales said tine in said scouring pad.

6. In combination, a scouring pad and a holder secured to said scouring pad:

a) said scouring pad comprising a body formed by coherent strand material defining interstitial spaces in said body, said strand material selected from the group consisting of ferrous metal, non-ferrous metal, or synthetic resinous material; and b) said holder comprising a hollow shell including a hollow tubular grasp-portion symmetrical about a longitudinal axis and having axially spaced opposed ends, a skirt portion integrally joined to one end of said hollow tubular grasp-portion and defining a shallow recess communicating with the interior of said hollow tubular grasp-portion, and tine means including a tine mounting portion mounted to said grasp-portion within said recess and an integral elongated wire spirally wound about said longitudinal axis to form a spiral tine having a free end portion extending out of said shallow recess and impaling said scouring pad body to retain a portion of said scouring pad body detachably secured in said recess and another portion thereof projecting out of said recess.

7. The combination according to claim 6, wherein the free end of said tine is spaced about one-fourth inch outside said recess.

8. Scouring apparatus for cleaning articles such as pots, pans, grills, griddles and diverse other equipment through use of a scouring pad, comprising:

a) a scouring pad holder adapted to detachably retain a scouring pad thereon for digital manipulation of said holder and an attached scouring pad to effect a scouring function;

b) said scouring pad holder comprising a hollow shell symmetrical about a central axis and including a tubular grasp-portion having axially spaced first and second ends joined by inner and outer peripheries, and a skirt portion having inner and outer peripheries, said inner periphery of said skirt portion being integrally joined to one end of said tubular grasp-portion and defining a shallow recess communicating with the interior of said tubular grasp-portion; and c) tine means mounted on said holder and including a tine mounting portion and a spirally wound tine extending from said tine mounting portion and projecting in a free end out of said recess for detachably impaling a scouring pad thereon to detachably retain said scouring pad mounted on said holder;

d) said skirt portion that defines said shallow recess including an annular plate portion perpendicular to the central axis and having its inner periphery joined integrally to said one end of said grasp-portion and its outer periphery joined integrally to the right truncated end of a conical skirt that diverges away from said central axis to a base edge lying in a plane parallel with said annular plate portion.

9. Scouring apparatus for cleaning articles such as pots, pans, grills, griddles and diverse other equipment through use of a scouring pad, comprising:

a) a scouring pad holder adapted to detachably retain a scouring pad thereon for digital manipulation of said holder and an attached scouring pad to effect a scouring function;

b) said scouring pad holder comprising a hollow shell symmetrical about a central axis and including a tubular grasp-portion having axially spaced first and second ends joined by inner and outer peripheries, and a skirt portion having inner and outer peripheries, said inner periphery of said skirt portion being integrally joined to one end of said tubular grasp-portion and defining a shallow recess communicating with the interior of said tubular grasp-portion; and c) tine means mounted on said holder and including a tine mounting portion and a spirally wound tine extending from said tine mounting portion and projecting in a free end out of said recess for detachably impaling a scouring pad thereon to detachably retain said scouring pad mounted on said holder;

d) said tine mounting portion extending diametrically across said one end of said tubular grasp-portion and is welded at opposite ends to said skirt portion.

10. Scouring apparatus for cleaning articles such as pots, pans, grills, griddles and diverse other equipment through use of a scouring pad, comprising:

a) a scouring pad holder adapted to detachably retain a scouring pad thereon for digital manipulation of said holder and an attached scouring pad to effect a scouring function;

b) said scouring pad holder comprising a hollow shell symmetrical about a central axis and including a tubular grasp-portion having axially spaced first and second ends joined by inner and outer peripheries, and a skirt portion having inner and outer peripheries, said inner periphery of said skirt portion being integrally joined to one end of said tubular grasp-portion and defining a shallow recess communicating with the interior of said tubular grasp-portion; and c) tine means mounted on said holder and including a tine mounting portion and a spirally wound tine extending from said tine mounting portion and projecting in a free end out of said recess for detachably impaling a scouring pad thereon to detachably retain said scouring pad mounted on said holder;

d) said tine mounting portion comprises a generally cylindrical helically wound portion mounted within the inner periphery of said tubular grasp-portion.

11. Scouring apparatus for cleaning articles such as pots, pans, grills, griddles and diverse other equipment through use of a scouring pad, comprising:

a) a scouring pad holder adapted to detachably retain a scouring pad thereon for digital manipulation of said holder and an attached scouring pad to effect a scouring function;

b) said scouring pad holder comprising a hollow shell symmetrical about a central axis and including a tubular grasp-portion having axially spaced first and second ends joined by inner and outer peripheries, and a skirt portion having inner and outer peripheries, said inner periphery of said skirt portion being integrally joined to one end of said tubular grasp-portion and defining a shallow recess communicating with the interior of said tubular grasp-portion;

c) tine means mounted on said holder and including a tine mounting portion and a spirally wound tine extending from said tine mounting portion and projecting in a free end out of said recess for detachably impaling a scouring pad thereon to detachably retain said scouring pad mounted on said holder; and d) a handle assembly is provided selectively detachably secured to said tubular grasp-portion.

12. Scouring apparatus for cleaning articles such as pots, pans, grills, griddles and diverse other equipment through use of a scouring pad, comprising:

a) a scouring pad holder adapted to detachably retain a scouring pad thereon for digital manipulation of said holder and an attached scouring pad to effect a scouring function;

b) said scouring pad holder comprising a hollow shell symmetrical about a central axis and including a tubular grasp-portion having axially spaced first and second ends joined by inner and outer peripheries, and a skirt portion having inner and outer peripheries, said inner periphery of said skirt portion being integrally joined to one end of said tubular grasp-portion and defining a shallow recess communicating with the interior of said tubular grasp-portion;

c) tine means mounted on said holder and including a tine mounting portion and a spirally wound tine extending from said tine mounting portion and projecting in a free end out of said recess for detachably impaling a scouring pad thereon to detachably retain said scouring pad mounted on said holder; and d) a handle assembly is provided selectively detachably secured to said tubular grasp-portion, said handle assembly including an elongated handle portion having means on one end thereof for detachably engaging said tubular grasp-portion, whereby manipulation of said handle assembly effects manipulation of said scouring pad holder and the scouring pad detachably mounted thereon.

13. In combination, a scouring pad and a holder secured to said scouring pad:

a) said scouring pad comprising a body formed by coherent strand material defining interstitial spaces in said body, said strand material selected from the group consisting of ferrous metal, non-ferrous metal, or synthetic resinous material; and b) said holder comprising a hollow shell including a tubular grasp-portion having axially spaced opposed ends, a skirt portion integrally joined to one end of said tubular grasp-portion and defining a shallow recess, and tine means within said recess and comprising an elongated wire spirally wound to form a tine having a free end portion extending out of said shallow recess and impaling said scouring pad body to retain a portion of said scouring pad body detachably secured in said recess and another portion thereof projecting out of said recess;

c) said tine means including a mounting portion extending diametrically across said one end of the grasp-portion to which said skirt is integrally attached.

14. In combination, a scouring pad and a holder secured to said scouring pad;

a) said scouring pad comprising a body formed by coherent strand material defining interstitial spaces in said body, said strand material selected from the group consisting of ferrous metal, non-ferrous metal, or synthetic resinous material; and b) said holder comprising a hollow shell including a tubular grasp-portion having axially spaced opposed ends, a skirt portion integrally joined to one end of said tubular grasp-portion and defining a shallow recess, and tine means within said recess and comprising an elongated wire spirally wound to form a tine having a free end portion extending out of said shallow recess and impaling said scouring pad body to retain a portion of said scouring pad body detachably secured in said recess and another portion thereof projecting out of said recess;

c) said tine means including a mounting portion comprising a helically wound wire mounted within said tubular grasp-portion, and said tine extending out of said recess comprises an integral extension of said helically wound wire mounting portion.

15. In combination, a scouring pad and a holder secured to said scouring pad;

a) said scouring pad comprising a body formed by coherent strand material defining interstitial spaces in said body, said strand material selected from the group consisting of ferrous metal, non-ferrous metal, or synthetic resinous material; and b) said holder comprising a hollow shell including a tubular grasp-portion having axially spaced opposed ends, a skirt portion integrally joined to one end of said tubular grasp-portion and defining a shallow recess, and tine means within said recess and comprising an elongated wire spirally wound to form a tine having a free end portion extending out of said shallow recess and impaling said scouring pad body to retain a portion of said scouring pad body detachably secured in said recess and another portion thereof projecting out of said recess;

c) said skirt portion that defines said shallow recess comprises an annular plate portion perpendicular to the tubular grasp-portion and having its inner periphery joined integrally to said one end of said tubular grasp-portion and its outer periphery joined integrally to the right truncated end of a conical skirt that diverges away from said tubular grasp-portion to a base edge lying in a plane parallel with said annular plate portion.

16. In combination, a scouring pad and a holder secured to said scouring pad:

a) said scouring pad comprising a body formed by coherent strand material defining interstitial spaces in said body, said strand material selected from the group consisting of ferrous metal, non-ferrous metal, or synthetic resinous material;

b) said holder comprising a hollow shell including a tubular grasp-portion having axially spaced opposed ends, a skirt portion integrally joined to one end of said tubular grasp-portion and defining a shallow recess, and tine means within said recess and comprising an elongated wire spirally wound to form a tine having a free end portion extending out of said shallow recess and impaling said scouring pad body to retain a portion of said scouring pad body detachably secured in said recess and another portion thereof projecting out of said recess; and c) a handle assembly detachably secured to said tubular grasp-portion.

* * * * *